US007895714B2

(12) United States Patent
Bossmann et al.

(10) Patent No.: US 7,895,714 B2
(45) Date of Patent: Mar. 1, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Johannes Bossmann, Mönchengladbach (DE); Thomas Schmitz, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 331 days.

(21) Appl. No.: 12/155,975

(22) Filed: Jun. 12, 2008

(65) Prior Publication Data

US 2009/0000076 A1 Jan. 1, 2009

(30) Foreign Application Priority Data

Jun. 29, 2007 (DE) ..... 10 2007 030 471
Jan. 11, 2008 (DE) ..... 10 2008 004 098

(51) Int. Cl.
*D01G 19/06* (2006.01)

(52) U.S. Cl. ..... 19/217

(58) Field of Classification Search ..... 19/115 R, 19/215, 216, 217

See application file for complete search history.

(56) References Cited

U.S. PATENT DOCUMENTS 1,408,780 A 3/1922 Schleifer
1,425,059 A 8/1922 Schleifer
1,694,432 A 12/1928 Schleifer
1,708,032 A 4/1929 Schleifer
1,715,473 A 6/1929 Schleifer
1,799,066 A 3/1931 Schleifer
2,044,460 A 6/1936 Bartram et al.
2,962,772 A 12/1960 Draving et al.

(Continued)

FOREIGN PATENT DOCUMENTS

DE 367482 1/1923

(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner*—Shaun R Hurley
(74) *Attorney, Agent, or Firm*—Venable LLP; Robert Kinberg; Steven J. Schwarz

(57) ABSTRACT

In an apparatus for the fiber-sorting or fiber-selection of fiber material which is supplied by means of a supply device to a fiber-sorting device, and a mechanical device is present which generates a combing action to remove non-clamped constituents such as short fibers, a clamping element is present. Downstream of the supply device there are arranged at least two rotatably mounted rollers with clamping devices for the fiber bundles, and the device for generating a combing action is associated with a said roller, wherein for the suction of the supplied fiber bundles, at least one suction device is associated with the clamping devices in the region of the transfer of the fiber bundle from the supply device to the first roller and/or in the region of the transfer of the fiber material from the first roller to the second roller.

22 Claims, 8 Drawing Sheets

U.S. PATENT DOCUMENTS

| | | | |
|---|---|---|---|
| 3,108,333 | A | 10/1963 | Schleifer |
| 4,270,245 | A | 6/1981 | Stewart et al. |
| 5,007,623 | A | 4/1991 | Unkuri et al. |
| 5,343,686 | A | 9/1994 | Buchner et al. |
| 5,404,619 | A | 4/1995 | Jorg |
| 5,457,851 | A | 10/1995 | Mondini |
| 5,502,875 | A | 4/1996 | Stolz et al. |
| 5,796,220 | A | 8/1998 | Clapp et al. |
| 6,163,931 | A | 12/2000 | Leifeld |
| 6,173,478 | B1 | 1/2001 | Patelli et al. |
| 6,216,318 | B1 | 4/2001 | Leifeld |
| 6,235,999 | B1 | 5/2001 | Rubenach |
| 6,295,699 | B1 | 10/2001 | Temburg |
| 6,499,194 | B1 | 12/2002 | Gresser et al. |
| 6,611,994 | B2 | 9/2003 | Bischofberger et al. |
| 7,173,207 | B2 | 2/2007 | Losbrock et al. |
| 2002/0124354 | A1 | 9/2002 | Pferdmenges et al. |
| 2003/0005551 | A1 | 1/2003 | Schurenkramer et al. |
| 2003/0029003 | A1 | 2/2003 | Breuer et al. |
| 2003/0070260 | A1 | 4/2003 | Rubenach |
| 2003/0154572 | A1 | 8/2003 | Pferdmenges et al. |
| 2004/0040121 | A1 | 3/2004 | Schmitz |
| 2004/0128799 | A1 | 7/2004 | Hosel et al. |
| 2005/0076476 | A1 | 4/2005 | Temburg |
| 2005/0198783 | A1 | 9/2005 | Rubenach |
| 2005/0278900 | A1 | 12/2005 | Dammig |
| 2006/0260100 | A1 | 11/2006 | Duda et al. |
| 2007/0180658 | A1 | 8/2007 | Saeger et al. |
| 2007/0180659 | A1 | 8/2007 | Saeger et al. |
| 2007/0180660 | A1 | 8/2007 | Saeger et al. |
| 2007/0266528 | A1 | 11/2007 | Farber et al. |
| 2008/0092339 | A1 | 4/2008 | Bossman et al. |
| 2009/0000064 | A1 | 1/2009 | Saeger et al. |
| 2009/0000065 | A1 | 1/2009 | Saeger et al. |
| 2009/0000066 | A1 | 1/2009 | Saeger et al. |
| 2009/0000067 | A1 | 1/2009 | Leder et al. |
| 2009/0000068 | A1 | 1/2009 | Saeger et al. |
| 2009/0000069 | A1* | 1/2009 | Saeger et al. ..... 19/115 R |
| 2009/0000070 | A1 | 1/2009 | Saeger et al. |
| 2009/0000071 | A1* | 1/2009 | Saeger et al. ..... 19/115 R |
| 2009/0000072 | A1* | 1/2009 | Saeger et al. ..... 19/115 R |
| 2009/0000073 | A1* | 1/2009 | Saeger et al. ..... 19/115 R |
| 2009/0000074 | A1 | 1/2009 | Bossmann |
| 2009/0000075 | A1 | 1/2009 | Saeger et al. |
| 2009/0000077 | A1 | 1/2009 | Saeger et al. |
| 2009/0000078 | A1* | 1/2009 | Saeger et al. ..... 19/233 |
| 2009/0000079 | A1* | 1/2009 | Bossmann ..... 19/80 A |

FOREIGN PATENT DOCUMENTS

| | | | |
|---|---|---|---|
| DE | 382169 | | 9/1923 |
| DE | 399885 | | 7/1924 |
| DE | 489 420 | | 1/1930 |
| DE | 30 48 501 | A1 | 7/1982 |
| DE | 103 20 452 | A1 | 11/2004 |
| EP | 1 586 682 | A | 10/2005 |
| WO | WO-2006/012758 | A1 | 2/2006 |

OTHER PUBLICATIONS

German Patent Office Search Report, dated Jul. 10, 2007, Issued in related German Patent Application No. 10 2006 050 453.4, and partial English-language translation.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

This application claims priority from German Patent Application No. 10 2007 030 471.6 dated Jun. 29, 2007, and German Patent Application No. 10 2008 004 098.3 dated Jan. 11, 2008, the entire disclosure of each which is incorporated herein by reference.

BACKGROUND OF THE INVENTION

The invention relates to an apparatus for the fibre-sorting or selection of a fibre bundle comprising textile fibres, especially for combing. In certain known apparatus, fibre slivers are supplied by means of a supply device to a fibre-sorting device, especially to a combing device, in which clamping devices are provided, which clamp the fibre bundle at a distance from its free end and mechanical means are present which generate a combing action from the clamping site to the free end of the fibre bundle in order to loosen and remove non-clamped constituents, such as, for example, short fibres, neps, dust and the like from the free end, wherein a clamping element is present to take up the supplied fibre material.

In practice, combing machines are used to free cotton fibres or woolen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre tuft and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre bundle supplied by the nipper assembly, a top comb and a fixed-position detaching device for detaching the combed-out fibre bundle from the nipper assembly. The lap ribbon supplied to the nipper assembly is here fed via a feed cylinder to a detaching roller pair. The fibre bundle protruding from the opened nipper passes onto the rearward end of a combed sliver web or fibre web, whereby it enters the clamping nip of the detaching rollers owing to the forward movement of the detaching rollers. In the process, the fibres that are not retained by the retaining force of the lap ribbon, or by the nipper, are detached from the composite of the lap ribbon. During this detaching operation, the fibre bundle is additionally pulled by the needles of a top comb. The top comb combs out the rear part of the detached fibre bundle and also holds back neps, impurities and the like. Owing to the differences in speed between the lap ribbon and the detaching speed of the detaching rollers, the detached fibre bundle is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nippers return to a rear position in which they are closed and present the fibre bundle protruding from the nippers to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the detaching rollers and the guide rollers, which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers and the guide rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed.

SUMMARY OF THE INVENTION

It is an aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

a fibre sorting device in which clamping devices are provided which each clamp a bundle of the textile fibres at a distance from its free end;

a supply device for supplying the fibre bundle to the fibre-sorting device; and at least one mechanical device for generating a combing action from the clamping site to the free end of the fibre bundle in order to loosen and remove non-clamped constituents;

wherein the fibre-sorting device comprises at least first and second rotatably mounted rollers that, in use, rotate rapidly without interruption, and clamping devices for fibre bundles distributed spaced apart in the region of the periphery of at least one said roller, wherein the device for generating a combing action is associated with at least one of said rollers, and wherein the fibre-sorting device further comprises at least one suction device associated with the clamping devices in the region of the transfer of the fibre bundle from the supply device to the first roller, and/or in the region of the transfer of the fibre material from the first roller to the second roller, for the suction of the supplied fibre bundles.

By implementing the functions of clamping and moving the fibre bundles to be combed-out on rotating rollers, preferably a turning rotor and a combing rotor, high operating speeds (nip rates) are achievable—unlike the known apparatus—without large mass accelerations and reversing movements. In particular, the mode of operation is continuous. When high-speed rollers are used, a very substantial increase in hourly production rate (productivity) is achievable which had previously not been considered possible in technical circles. A further advantage is that the rotary rotational movement of the rollers with the plurality of clamping devices leads to an unusually rapid supply of a plurality of fibre bundles per unit of time to the first roller and to the second roller. In particular the high rotational speed of the rollers allows production to be substantially increased.

To form the fibre bundle, the fibre material pushed forward by the feed roller is clamped at one end by a clamping device and detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre sliver is transferred from the turning rotor onto the combing rotor the ends of the fibre sliver are reversed: the clamping device on the combing rotor grips and clamps the end with the long fibres, so that the region with the short fibres projects from the clamping device and lies exposed and can thereby be combed out.

The fibre bundles are—unlike the known apparatus—held by a plurality of clamping devices and transported under rotation. The clamping point at the particular clamping devices therefore remains substantially constant on each roller until the fibre bundles are transferred to the subsequent roller or take-off roller. A relative movement between clamping device and fibre bundle does not begin until after the fibre bundle has been gripped by the subsequent roller, especially the take-off roller, and in addition clamping has been terminated. Because a plurality of clamping devices is available for the fibre bundles, in an especially advantageous manner fibre bundles can be supplied to the first or second roller respectively one after the other and in quick succession, without undesirable time delays resulting from just a single supply device. A particular advantage is that, for support, the supplied fibre bundles are additionally acted upon by suction. The free end of the fibre bundles is gripped very quickly and drawn into the clamping device whilst the clamping device is open, which leads to a further considerable increase in production speed. The suction air currents advantageously have an influence on the alignment and movement of the fibre bundles to be transported.

In certain preferred embodiments, at transfer, before the clamping by the clamping devices, a suction air current acts on the supplied fibre bundles. Advantageously, the suction air current influences the alignment and movement of the fibre bundles to be supplied and taken up. Advantageously, after clamping of the free regions of the fibre bundles the clamping of the clamped ends is arranged to be terminated. Advantageously, at least one blowing opening is provided in the region of the delivery of the fibre bundle from the supply device to the first roller and/or in the region of the delivery of the fibre material from the first roller to the second roller. Advantageously, the blowing device is associated with the supply device. For suction of the fibre material, the opening of the suction device may advantageously be arranged at the first roller in the region of the supply device (feed roller). As well or instead, an opening of a suction device may advantageously be arranged at the second roller in the region of the transfer of the fibre material between the first roller and the second roller. Advantageously, the suction device is of channel-like construction. Advantageously, the suction channel has an open end with a suction opening. Advantageously, the suction channel has another end that is connected to an reduced pressure region. Advantageously, the suction channels are arranged inside the first roller and/or inside the second roller. Advantageously, the suction channels rotate with the first roller and/or the second roller. Advantageously, at least one suction channel is associated with each nipper device (upper nipper, lower nipper). Advantageously, the suction channel is arranged substantially between the gripper element (upper nipper) and the counter-element (lower nipper). Advantageously, a reduced pressure region is present in the interior of the first roller and/or the second roller. Advantageously, the suction channels are connected to the reduced pressure region. Advantageously, the reduced pressure region is connected to a source of suction, e.g. a flow-generating machine. Advantageously, the suction flow at the individual suction channels between the reduced pressure region and the suction channel is adjustable in such a manner that the suction flow is applied only at particular adjustable (predetermined) angular positions on the circumference of the roller. Advantageously, valves are provided for the adjustment of predetermined angular positions. For the adjustment, a fan with openings is advantageously provided at the predetermined angular positions. Advantageously, the release of the suction flow can be effected by the movement of the gripper element (upper nipper). Advantageously, a reduced pressure region is arranged only at the predetermined angular positions. Advantageously, a blown air device is provided in the region of the supply device. Advantageously, a blown air current is provided in the region of the transfer between the first roller and the second roller. In certain embodiments, in the region of the supply device, an element for generating the blown air current may be fixedly arranged directly below and/or directly above the supply device. In other embodiments, the blown air source may be arranged inside the supply device. Advantageously, the blown air current acts, through the air-permeable surface of the supply device or through air passage openings, in the direction of the first roller. Advantageously, a blown air current source is arranged in the region of transfer between the first roller and the second roller directly below and/or above each nipper device. Advantageously, between the supply device and the first roller a screen element is arranged above the fibre material. Advantageously, between the supply device and the first roller a respective screen element is arranged laterally of the fibre material. Advantageously, air guide elements for the air currents are present. Advantageously, the at least two rotatably mounted rollers comprise at least one turning rotor and at least one combing rotor. Advantageously, the turning rotor and the combing rotor have opposite directions of rotation. To assist the suction of the supplied fibre slivers, at least one blowing device is advantageously associated with the clamping devices in the region of the transfer of the fibre bundle from the supply device to the first roller and/or in the region of the transfer of the fibre material from the first roller to the second roller.

The invention also provides an apparatus for the fibre-sorting or fibre-selection of a fibre bundle comprising textile fibres, especially for combing, which is supplied by means of supply means to a fibre-sorting device, especially a combing device, in which clamping devices are provided which clamp the fibre bundle at a distance from its free end, and mechanical means are present which generate a combing action from the clamping site to the free end of the fibre bundle, in order to loosen and remove non-clamped constituents, such as, for example, short fibres, neps, dust and the like from the free end, wherein for transfer of the supplied fibre material a clamping element is present, characterised in that downstream of the supply means there are arranged at least two rotatably mounted rollers rotating rapidly without interruption which are provided with clamping devices for the fibre bundles transported in rotation, which clamping devices are distributed spaced apart in the region of their periphery, and the means for generating a combing action (combing elements) are associated with at least one said roller, wherein for suction of the supplied fibre bundles, at least one suction device is associated with the clamping devices in the region of the transfer of the fibre bundle from the supply device to the first roller and/or in the region of the transfer of the fibre material from the first roller to the second roller.

DETAILED DESCRIPTION OF CERTAIN PREFERRED EMBODIMENTS

Figure 1:
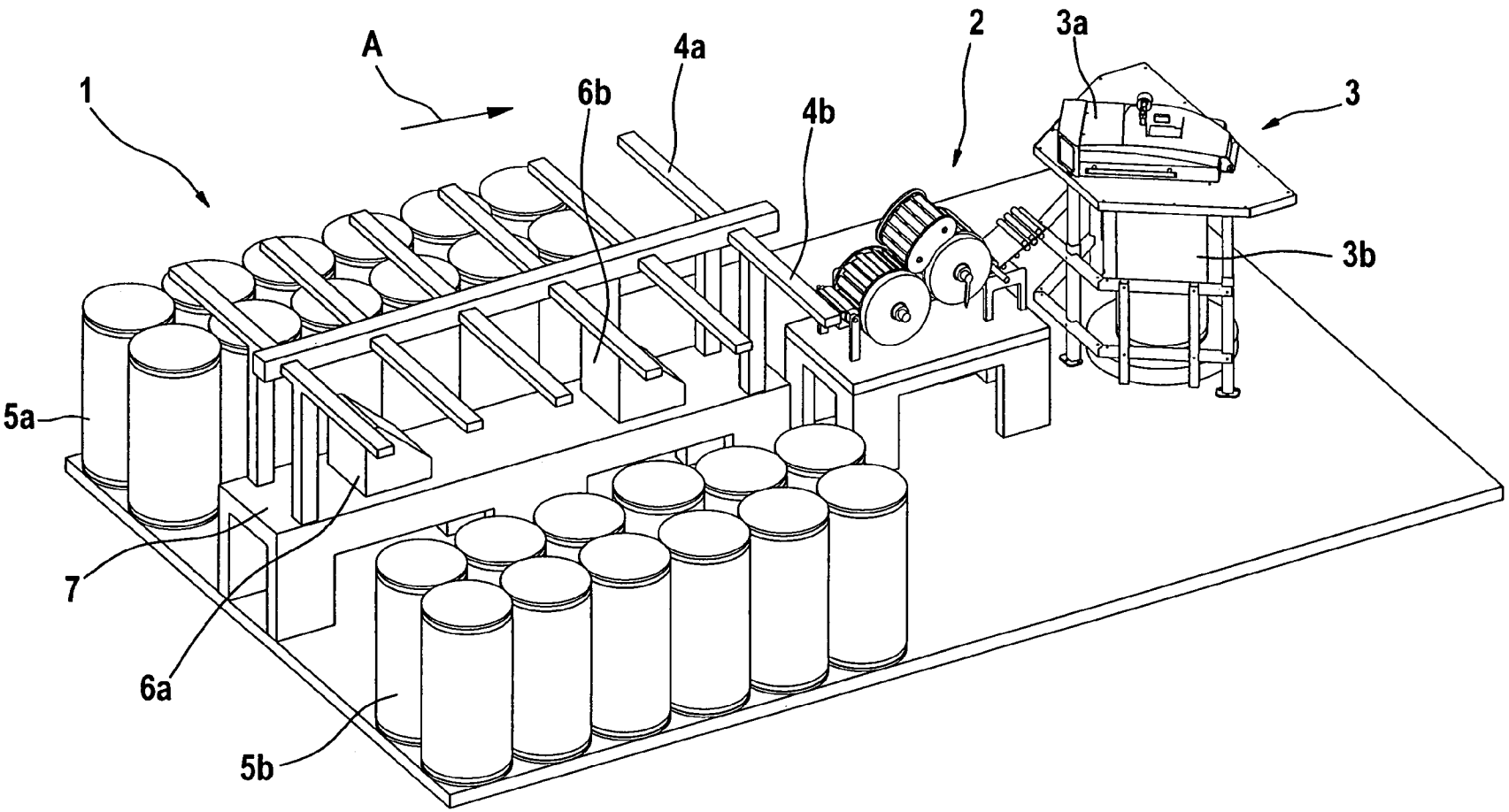
FIG. 1 is a diagrammatic perspective view of a device for combing fibre material, comprising a combing preparation device, a rotor combing machine and a sliver-deposition device.

With reference to FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further embodiment, more than one rotor combing machine 2 is provided. If, for example, two rotor combing machines are present, then the two delivered comber slivers 17 can pass together through the downstream autoleveller drafting system 50 and be deposited as one drafted comber sliver in the sliver-deposition device 3.

The sliver-deposition device 3 comprises a rotating coiler head 3*a*, by which the comber sliver can be deposited in a can 3*b* or (not shown) in the form of a canless fibre sliver package.

Figure 2:
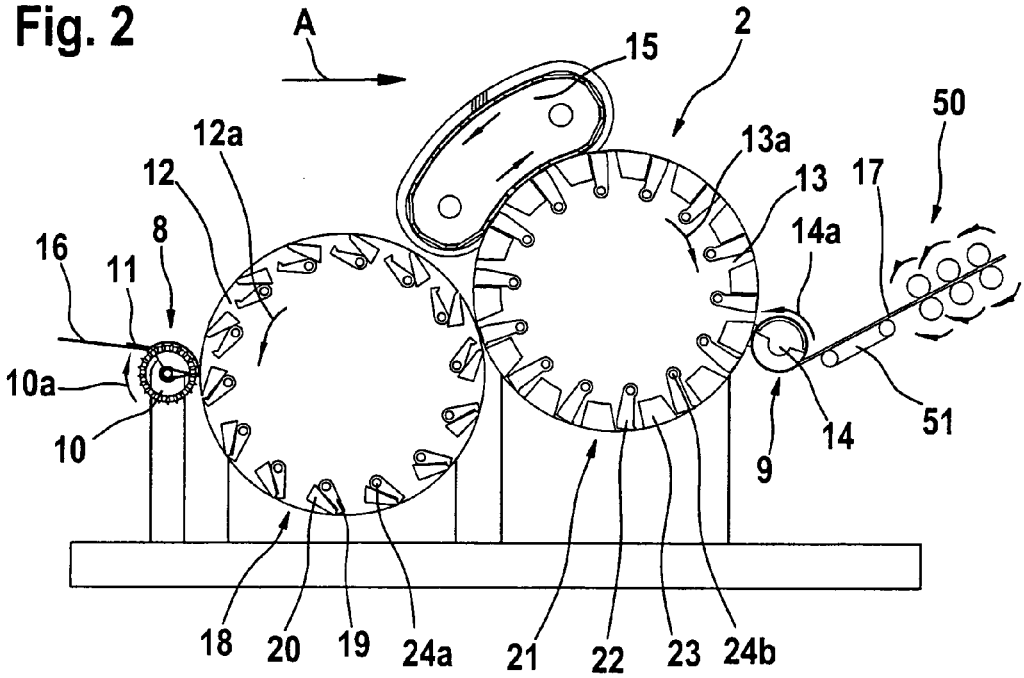
FIG. 2 is a diagrammatic side view of a rotor combing machine according to the invention having two rollers.

FIG. 2 shows a rotor combing machine 2 having a supply device 8 comprising a feed roller 10 and a feed tray 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a* which is attached to the roller 12. The lower nipper 20 is mounted on the roller 12 so as to be either fixed or movable. The free end of the upper nipper 19 faces the periphery of the roller 12. The upper nipper 19 and the lower nipper 20 cooperate so that they are able to grip a fibre bundle 16, $\mathbf{30}_1$, $\mathbf{30}_2$ (clamping) and release it.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is mounted on the roller 13 so as to be either fixed (see FIG. 9) or movable. The free end of the upper nipper 22 faces the periphery of the roller 13. The upper nipper 22 and the lower nipper 23 co-operate so that they are able to grip a fibre bundle $\mathbf{30}_2$ (clamping) and release it. In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. Reference numeral 51 denotes a driven ascending conveyor, for example a conveyor belt. It is also possible to use an upwardly inclined metal sheet or the like for conveying purposes.

Figure 3:
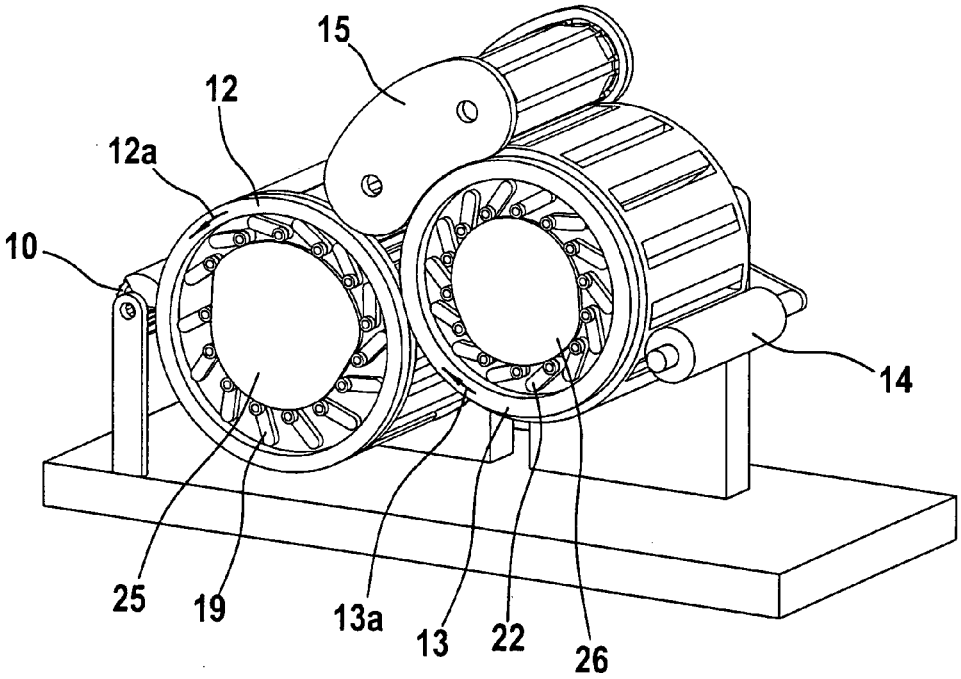
FIG. 3 is a perspective view of a rotor combing machine constructed generally as shown in FIG. 2 and further have two cam discs.

In the embodiment of FIG. 3, two fixed cam discs 25 and 26 are provided, about which the roller 12 having the first clamping devices 18 and the roller 13 having the second clamping devices 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26, the upper nippers 19 and 22 are rotated about pivot axes 24*a* and 24*b*, respectively. In that way, the opening and closing of the first clamping devices 18 and the second clamping devices 21 is implemented.

Figure 4:
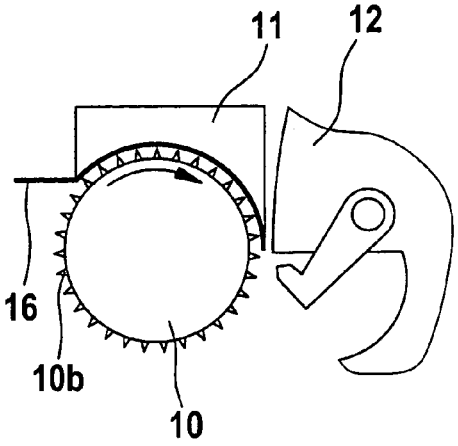
FIG. 4 shows an embodiment of the invention in which a top comb roller acts as supply device.
Figure 5:
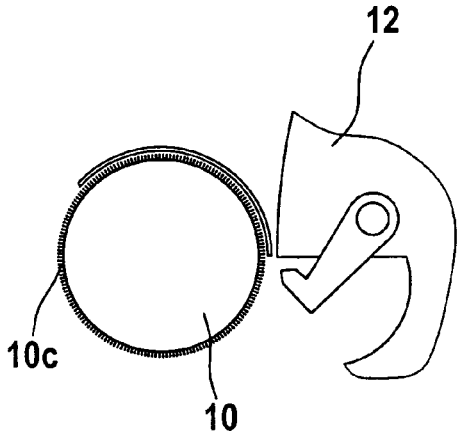
FIG. 5 shows an embodiment of the invention in which a clothed roller acts as supply device.
Figure 6A:
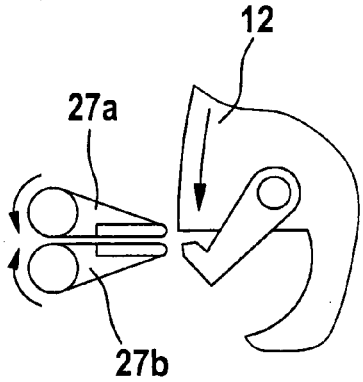
FIGS. 6*a*, 6*b* show embodiments of the invention in which two arrangements of a double belt device act as supply device.
Figure 6B:
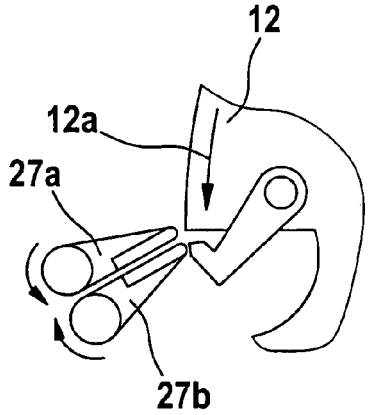
Figure 7A:
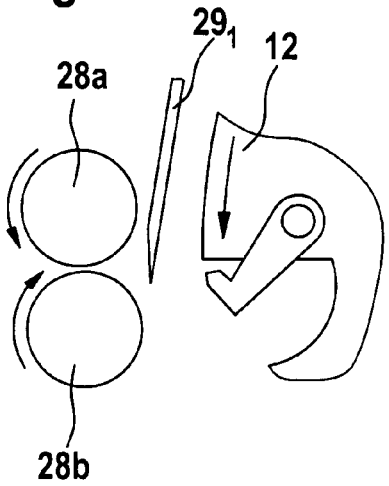
FIGS. 7*a*, 7*b* show embodiments of the invention in which two feed rollers act as supply device, having a fixed comb from above (FIG. 7*a*) and from below (FIG. 7*b*)
Figure 7B:
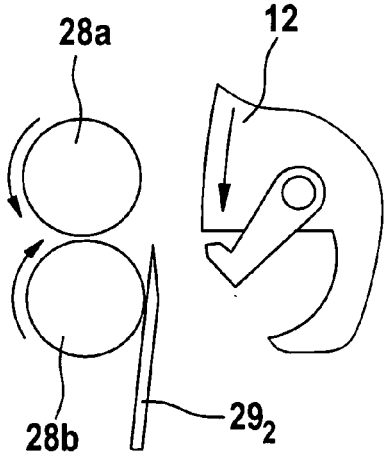

In the embodiment of FIG. 4, the feed roller 10 has around its periphery comb segments 10*b* which are arranged axially parallel across the width. In the embodiment of FIG. 5, the feed roller 10 has around its periphery a clothing 10*c*, preferably all-steel clothing. In the embodiments of FIGS. 6*a*, 6*b*, the supply device consists of two endlessly revolving belts 27*a*, 27*b*, between which there is a conveyor gap for the incoming fibre lap 16. The conveyor gap in FIG. 6*a* is arranged substantially radially with respect to the roller 12, while the conveyor gap in FIG. 6*b* is arranged opposite the direction of rotation 12*a*. In the embodiments FIGS. 7*a* and 7*b*, between a feed roller pair 28*a*, 28*b* (for directions of rotation see curved arrows) and the first roller 12 there is arranged a fixed comb $\mathbf{29}_1$, and $\mathbf{29}_2$, respectively, the comb teeth of the fixed comb $\mathbf{29}_1$ engaging the fibre lap 16 from above and the comb teeth of the fixed comb $\mathbf{29}_2$ engaging the fibre lap 16 from below.

Embodiments of the invention in which the apparatus has a suction device (see FIGS. 8*a* to 8*c*, 9*a* to 9*c*, 10 and 12) and/or a blowing device (see FIG. 10 to 12) can include one of the arrangements illustrated in FIGS. 4 to 7.

In respect of the mode of operation and operating sequence of an illustrative apparatus according to the invention:

Lap Preparation

A plurality of slivers is combined to form a lap 16 and drafted together. A plurality of laps 16 can be doubled by being placed one on top of the other. The resulting lap 16 is introduced directly into the feed element 10 of the rotor combing machine 2. The flow of material is not interrupted by forming a wound lap.

Feed

Unlike a flat combing machine, the upstream lap 16 is fed continuously by means of a conveyor element. The feed quantity is determined by the length of lap 16 conveyed between two closure time points of the nippers 18 (reversing nippers) of the first rotor 12 (turning rotor).

Clamping 1

The fibre tuft aligned and projecting out of the lap 16 is clamped by a clamping device 18 (reversing nipper) of the first rotor 12 (turning rotor). The clamping device 18 of the first rotor 12 assumes the function of detachment.

Delivery from the supply device onto, and take up by, the first roller with suction device.

Figure 8A:
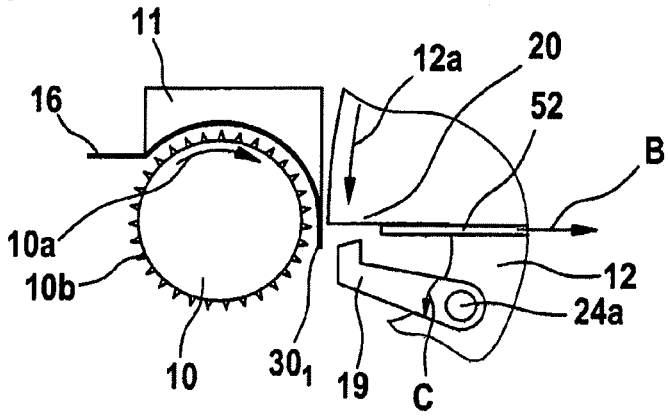
FIGS. 8*a* to 8*c* show in diagrammatic form the operating sequence during transfer of a supplied fibre bundle from the supply device onto, and take up by, the first roller with suction device.
Figure 8B:
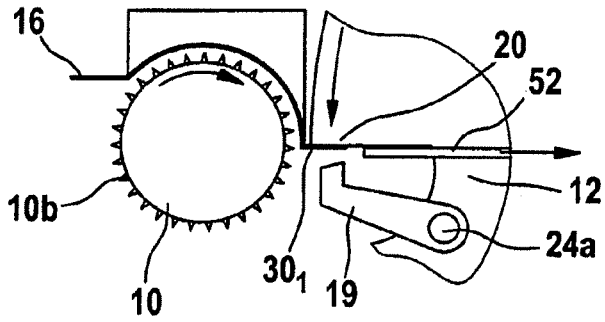
Figure 8C:
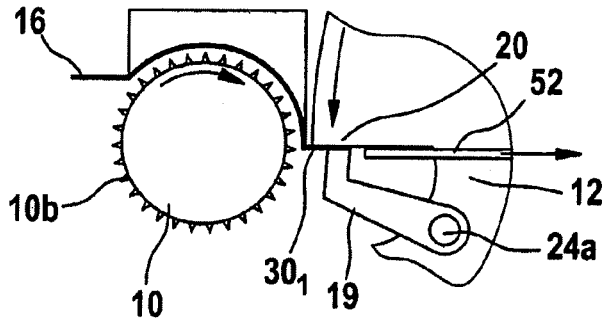

FIGS. 8*a*, 8*b* and 8*c* show in diagrammatic form the operating sequence during transfer of the supplied fibre material $\mathbf{30}_1$ from the feed roller 10 to the first roller 12 (turning rotor) acted upon by suction and the take-up of the supplied fibre material $\mathbf{30}_1$ from the feed roller 10 by the first roller 12 acted upon by suction, the Figures showing one after the other in chronological order: according to FIG. 8*a*, intake of the fibre material 16 by the feed roller 10 in direction 10*a* and advance of the free end $\mathbf{30}_1$ into the suction region of the roller 12 with clamping of the fibre material between the comb segments 12*b* and the nose of the feed trough 11. FIG. 8*b* shows suction of the free end $\mathbf{30}_1$ by the air current B of the suction channel 52 between the upper nipper 19 and the lower nipper 20. Through the suction, the fibre bundle $\mathbf{30}_1$ is bent at an angle and straightened. In this operation, the fibre bundle $\mathbf{30}_1$ continues to be clamped between feed roller 10 and feed trough 11. In accordance with FIG. 8*c*, a rotation of the upper nipper 19 around the pivot joint 24*a* in direction C is effected and thereby a closure of the clamping device 18, wherein an end region of the fibre bundle $\mathbf{30}_1$ is clamped between upper nipper 19 and lower nipper 20.

Removal

As a result of the rotation of the turning rotor 12 in direction 12*a* with the reversing nippers 18 located thereon, the clamped fibre tuft is removed from the feed lap, it being necessary for a retaining force to act on the lap 16 so that the fibres in the lap 16 not clamped by the reversing nipper 18 are retained. The retaining force is applied by the conveyor element of the feed means or by additional means such as a feed tray 11 or a top comb. The elements that generate the retaining force assume the function of the top comb.

Clamping 2

The fibre tuft is aligned and transferred to the clamping device 21 (combing nipper) of the second rotor 13 (combing rotor). The distance between the reversing nipper clamping line and the combing nipper clamping line at the time the combing device 21 closes determines the ecartement.

Delivery from the first roller onto, and take up by, the second roller with suction device.

Figure 9A:
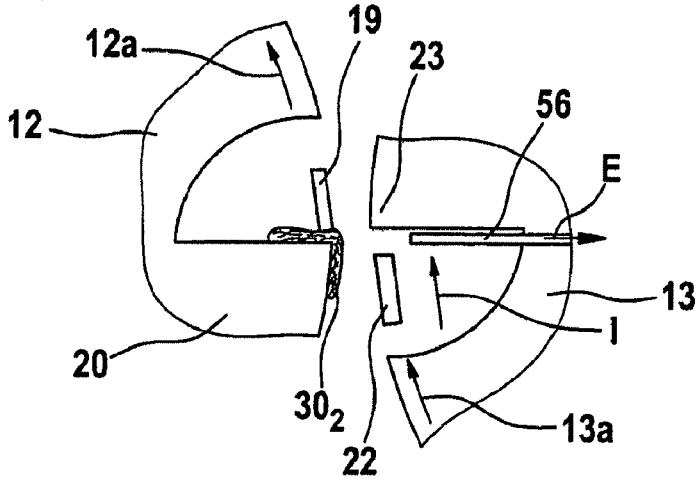
FIGS. 9*a* to 9*c* show in diagrammatic form the operating sequence during transfer of a fibre bundle transported in rotation from the first roller onto, and take up by, the second roller with suction device.
Figure 9B:
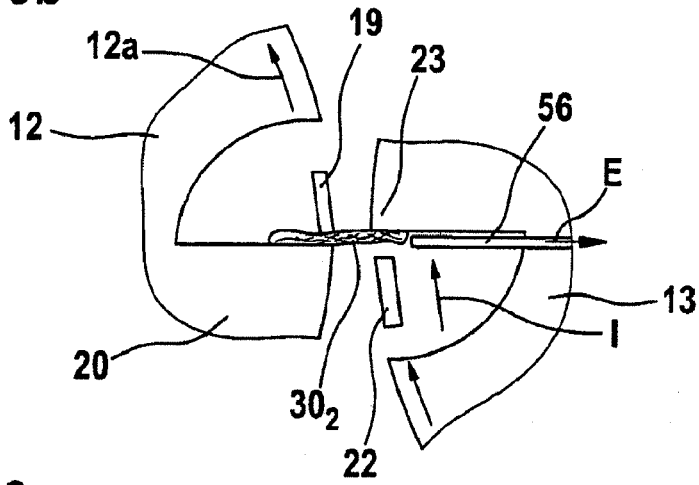
Figure 9C:
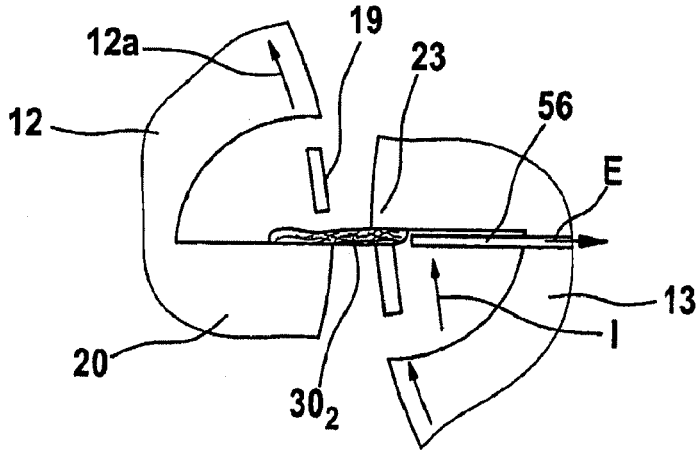

FIGS. 9*a*, 9*b* and 9*c* show in diagrammatic form the operating sequence during transfer of the supplied fibre material $\mathbf{30}_2$ from the first roller 12 to the second roller 13 (turning rotor) acted upon by suction and the take-up of the supplied fibre material $\mathbf{30}_2$ from the first roller 12 by the second roller 13 acted upon by suction, the Figures showing in chronological order:

FIG. 9*a* shows transport of the fibre bundle $\mathbf{30}_2$ by the roller 12 in direction 12*a* into the suction region of the roller 13 with clamping of the clamped end of the fibre bundle $\mathbf{30}_2$ by the closed clamping device 18 comprising upper nipper 19 and lower nipper 20. FIG. 9*b* shows suction of the free end of the fibre bundle $\mathbf{30}_2$ by the air current E of the suction channel 56 between the upper nipper 22 and the lower nipper 23. Through the suction, the fibre bundle $\mathbf{30}_2$ bent at an angle is stretched out and aligned. In this operation, the one end region of the fibre bundle $\mathbf{30}_2$ continues to be clamped between upper nipper 19 and lower nipper 20 of the closed clamping device 18. FIG. 9*c* shows a rotation of the upper nipper 22 around the pivot joint 24*b* in direction I is effected and thereby a closure of the clamping device 21, wherein the other end region of the fibre bundle $\mathbf{30}_2$ is clamped between upper nipper 22 and lower nipper 23.

Combing

The fibre tuft projecting out of the combing nipper 21 contains non-clamped fibres that are eliminated by means of combing.

Piecing

The combed-out fibre tuft is deposited on a take-off roller 14. The surface of the take-off roller 14, which surface is acted upon by suction and is air-permeable, causes the fibre tuft to be deposited, stretched-out, on the take-off roller 14. The fibre tufts are placed one on top of the other, overlapping in the manner of roof tiles, and form a web.

The web 17 is removed from the take-off roller 14 at a point on the take-off roller not acted upon by suction and is guided into a funnel.

Comber Sliver Procedure

The resulting comber sliver can be doubled and drafted (drafting system 50) and is then deposited, for example, in a can 3*b* by means of coiler 3*a*.

Figure 10:
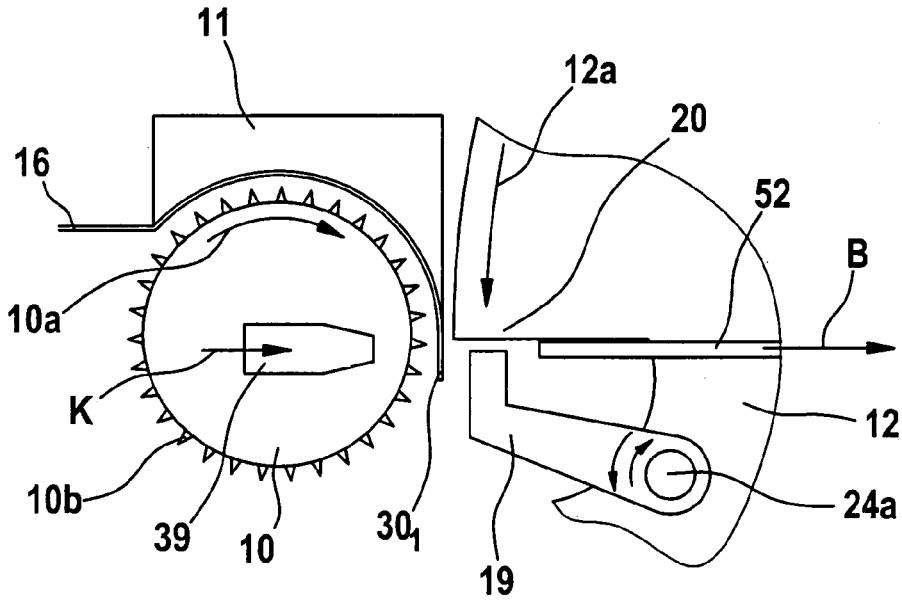
FIG. 10 shows an embodiment of the invention in which a supply device as in FIG. 8*a* to 8*c* has a suction device associated with the first roller and additionally has a blown air nozzle arranged inside the feed roller.

In the embodiment of FIG. 10, a supply device 8 as in FIG. 8*a* to 8*c* is shown with a suction channel 52 associated with the first roller 12. In addition, inside the feed roller there is a blast air nozzle 39, which is connected to a source of blown air (not illustrated). The cylinder casing of the feed roller 10 has openings, which allow the passage of the blown air current K. The blown air current K is directed onto the fibre bundle $\mathbf{30}_1$. The blown air current K is substantially in alignment with the suction air current B.

Figure 11:
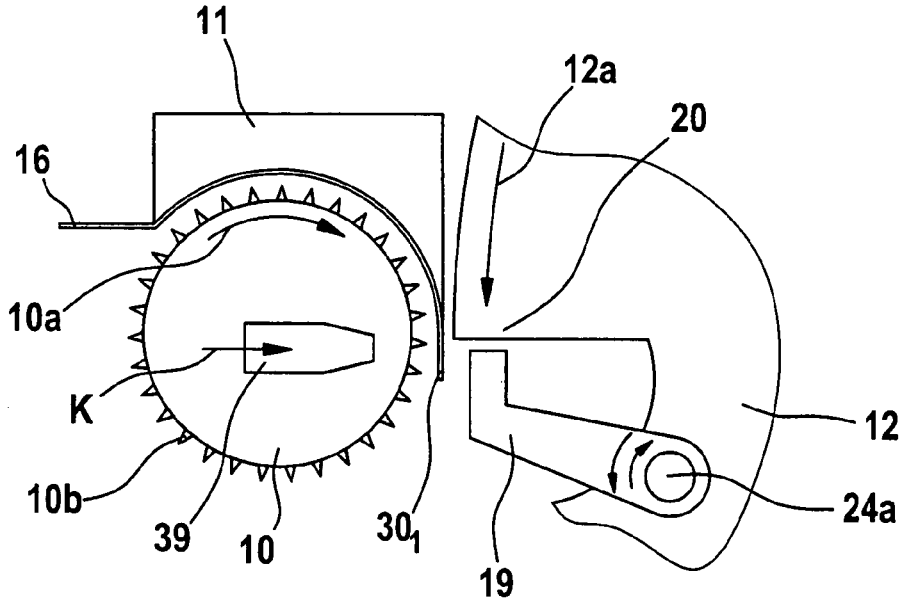
FIG. 11 shows a supply device with a blown air nozzle arranged inside the feed roller.

FIG. 11 shows an embodiment similar to FIG. 10, but differing in that only a blown air channel 39, i.e. no suction channel 52, is provided.

Figure 12:
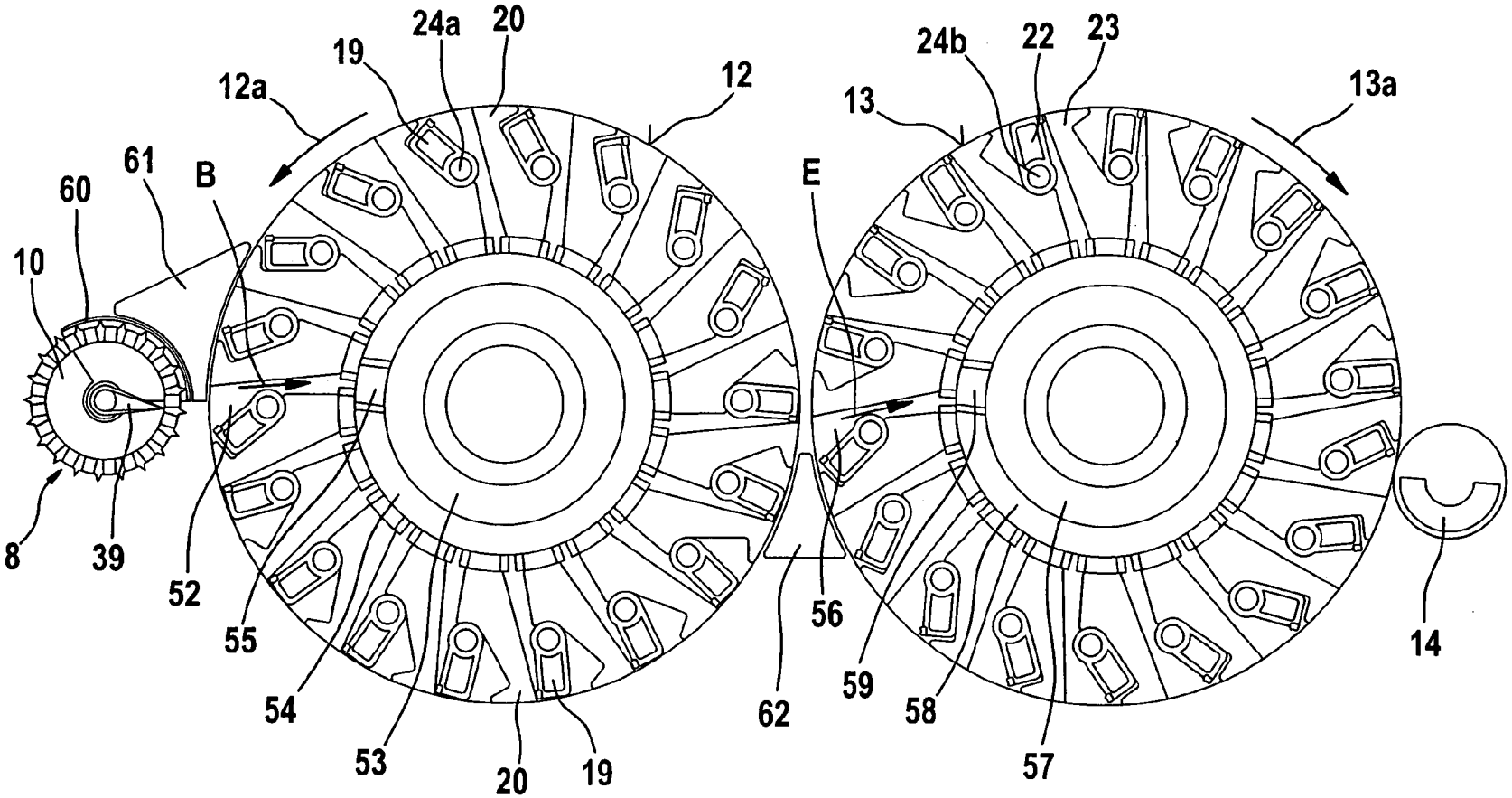
FIG. 12 shows an embodiment of the invention in which a rotor combing machine generally as in FIG. 2 has reduced pressure channels and suction openings, associated in each case with the clamping devices of the first and second rollers, as well as a blown air nozzle inside the supply roller.

In the embodiment of FIG. 12, the rotatably mounted rollers 12 and 13 with clamping devices 19, 20 and 22, 23 respectively are additionally fitted with suction channels 52 and 56 respectively (suction openings) which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure region 53 to 55 and 57 to 59, respectively, created by the suction flow at the suction openings 52, 56. The reduced pressure can be generated by connecting to a flow-generating machine. The suction flow at the individual suction openings 52, 56 can be so switched between reduced pressure region and suction opening that it is applied only at particular selected angular positions on the roller circumference. For the purpose of the switching, valves or a valve pipe 54, 58 with openings 55 and 59, respectively, in the corresponding angular positions, can be used. The release of the suction flow may also be brought about by the movement of the gripping element (upper nipper). Furthermore, it is possible to arrange a region of underpressure only at the corresponding angular positions.

Additionally, a flow of blown air can be provided in the region of the supply device 8 and/or in the region of transfer between the rollers. The source of the flow of blown air (blowing nozzle 39) is arranged inside the feed roller 10 and acts, through the air-permeable surface of the supply device or through air passage openings, towards the outside in the direction of the first roller. Also, in the region of the supply device 8, the element for producing the blown air current can be fixedly arranged, directly under or over the supply device 8. In the region of the transfer between the rollers 12, 13 the blown air current sources can be arranged at the rotor perimeter of the first roller 12, directly under or over each nipper device. For the blown air generation there may be used compressed air nozzles and/or air blades.

The suction flow B can favourably influence and shorten not only the guiding, but also the separation process between the lap and the tufts to be removed in the region of the supply device 8.

As a result of the provision of additional air guide elements 60 and lateral screens 61, 62 the direction of the flow can be influenced and the air carried round with the rotors separated off. In that way, the time for alignment can be further shortened. In particular, a screen element between the first rotor 12 and supply device 8 over the lap and a screen element on each side of the roller have proved useful.

The combed-out fibre portion passes from the second roller 13 onto the piecing roller 14.

Figure 13:
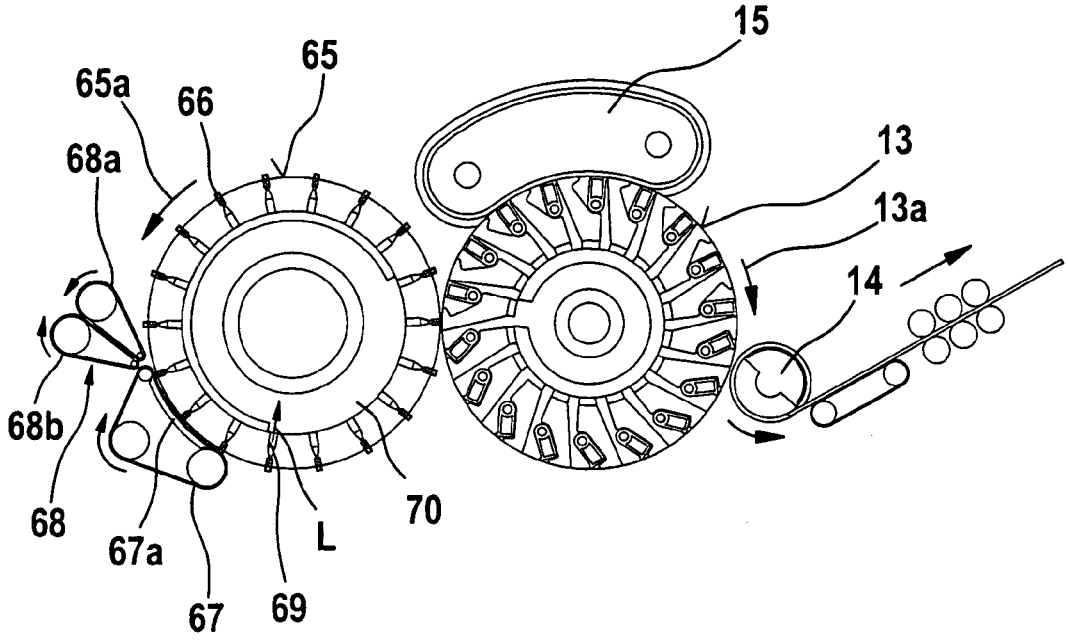
FIG. 13 is a diagrammatic side view of a further embodiment of the rotor combing machine, according to the invention in which on the first roller (turning rotor) counter-elements are arranged lying opposite and the fibre bundle (fibre portion) is acted upon by suction.

In the embodiment of FIG. 13, clamping elements 66 are present at the first roller 65 (turning rotor), opposite which a conveyor belt 67 is arranged as counter-element, and in which the fibre bundle is held by suction on the first roller 65. The first roller 65 rotates in the direction 65*a*.

The fibre material is fed by a supply device 68 comprising two co-operating continuously revolving conveyor belts 68*a*, 68*b* into the gap between the roller 65 and the conveyor belt 67. Through clamping between the clamping elements 66 and the belt portion 67*a* of the conveyor belt 67 facing towards the roller 65, fibre sliver bundles are formed and carried out of the gap between the roller 65 and the conveyor belt 67. Subsequently an end region of each sliver bundle is firmly held by a suction air current "L" of a suction channel 69, which is connected to an underpressure region 70, on the surface of the roller 65. The fibre bundle is subsequently transferred onto the second roller 13, (combing rotor). The combed-out fibre material passes from the second roller 13 onto the piecing roller 14.

Figure 14:
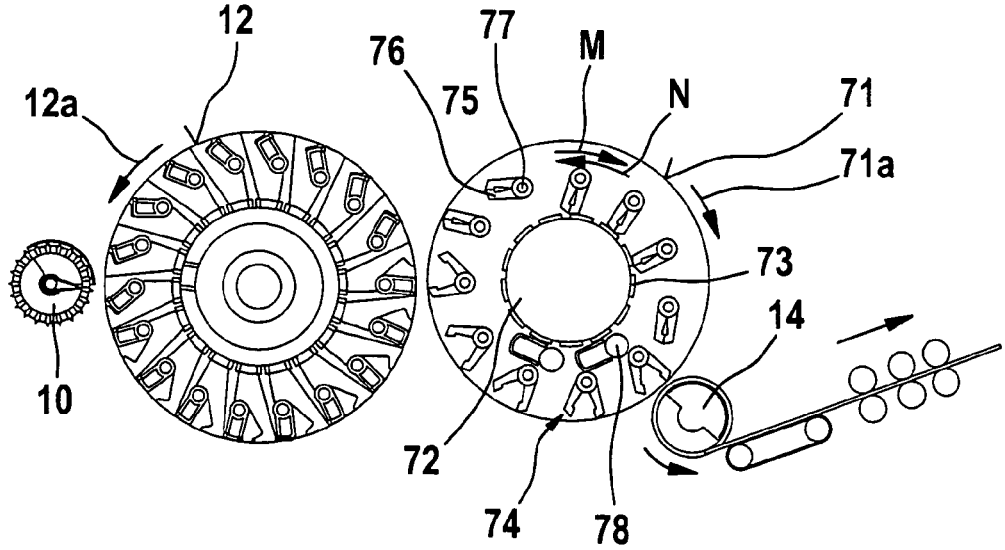
FIG. 14 is a diagrammatic side view of another embodiment of the rotor combing machine according to the invention, in which combing elements are arranged inside the combing rotor.

In the embodiment of FIG. 14, a first roller 12 (turning rotor) is provided, which is illustrated in FIG. 12. The fibre bundle is transferred from the first roller 12 onto a second roller 71 (combing rotor). The second roller 71 rotates in the direction 71*a*. Inside the second roller 71, a further roller 72 equipped with a plurality of combing elements 73 rotates. The roller 72 is mounted concentrically with respect to the axis of the second roller 71. The roller 72 rotates continuously and uniformly in the same direction as or in the opposite direction to the combing rotor 71. The nipper devices 74 consist of an upper nipper 75 and a lower nipper 76, which with their one end are rotatable about a pivot bearing 77 in direction M, N. In the closed state, the nipper devices 74 present the clamped fibre tufts to the combing elements 73 for combing. Through the relative movement between fibre tuft and combing element 73 the fibre tuft is combed out. Inside the rotor 71 there is a cleaning device, for example, a rotating cleaning roller 78, which cleans the combing elements 73. In the case of same-direction combing, the speed ratio between combing rotor 71 and the roller 72 with combing elements 73 is greater than 1. The combed-out fibre bundle passes from the combing rotor 71 onto the piecing roller 14.

Using the rotor combing machine according to the invention there is achieved a mechanical combing of the fibre material to be combed out, that is, mechanical means are used for the combing. There is no pneumatic combing of the fibre material to be combed, that is, no air currents, e.g. suction and/or blown air currents, are used for combing.

The circumferential speeds are, for example, for the feed roller about from 0.2 to 1.0 m/sec; the first roller 12 about from 2.0 to 6.0 m/sec; the second roller 13 about from 2.0 to 6.0 m/sec; the doffer about from 0.4 to 1.5 m/sec; and the revolving card top assembly about from 1.5 to 4.5 m/sec. The diameter of the first roller 12 and the second roller 13 is, for example, about from 0.3 m to 0.8 m.

Using the rotor combing machine 2 according to the invention, more than 2000 nips/min, for example from 3000 to 5000 nips/min, are achieved.

In the rotor combing machine according to the invention there are present rollers that rotate rapidly without interruption (continuously) and that have clamping devices. Rollers that rotate with interruptions, stepwise or alternating between a stationary and rotating state are not used.

Although the foregoing invention has been described in detail by way of illustration and example for purposes of understanding, it will be obvious that changes and modifications may be practised within the scope of the appended claims.

What is claimed is:

1. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle;

a supply device adapted to supply the fibre bundle to the fibre-sorting device; and at least one mechanical device adapted to generate a combing action from the clamping site to the free end of the fibre bundle in order to loosen and remove non-clamped constituents, wherein the mechanical device is associated with at least one of the first and second rollers; and wherein the fibre-sorting device further comprises at least one suction device associated with the clamping devices in a region of transfer of the fibre bundles from the supply device to the first roller, and/or in a region of transfer of the fibre bundles from the first roller to the second roller, wherein the suction device generates a suction air current that acts on the fibre bundles during transfer before clamping by the clamping devices.

2. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle;

a supply device adapted to supply the fibre bundle to the fibre-sorting device; and at least one mechanical device adapted to generate a combing action from the clamping site to the free end of the fibre bundle in order to loosen and remove non-clamped constituents, wherein the mechanical device is associated with at least one of the first and second rollers; and wherein the fibre-sorting device further comprises at least one suction device associated with the clamping devices in a region of transfer of the fibre bundles from the supply device to the first roller, and/or in a region of transfer of the fibre bundles from the first roller to the second roller, wherein the suction air current influences the alignment and movement of the fibre bundles to be supplied and taken up.

3. An apparatus according to claim 1, in which, following clamping of the free ends of the fibre bundles, the clamping of the clamped ends is releasable.

4. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle;

a supply device adapted to supply the fibre bundle to the fibre-sorting device; and at least one mechanical device adapted to generate a combing action from the clamping site to the free end of the fibre bundle in order to loosen and remove non-clamped constituents, wherein the mechanical device is associated with at least one of the first and second rollers; and wherein the fibre-sorting device further comprises at least one suction device associated with the clamping devices in a region of transfer of the fibre bundles from the supply device to the first roller, and/or in a region of transfer of the fibre bundles from the first roller to the second roller, wherein the suction device includes an opening arranged at the first roller in the region of the supply device.

5. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle;

a supply device adapted to supply the fibre bundle to the fibre-sorting device; and at least one mechanical device adapted to generate a combing action from the clamping site to the free end of the fibre bundle in order to loosen and remove non-clamped constituents, wherein the mechanical device is associated with at least one of the first and second rollers; and wherein the fibre-sorting device further comprises at least one suction device associated with the clamping devices in a region of transfer of the fibre bundles from the supply device to the first roller, and/or in a region of transfer of the fibre bundles from the first roller to the second roller, wherein the suction device includes an opening arranged at the second roller in the region of the transfer of the fibre bundles between the first roller and the second roller.

6. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of the textile fibers at a distance from a free end of the bundle;

a supply device adapted to supply the fibre bundle to the fibre-sorting device; and at least one mechanical device adapted to generate a combing action from the clamping site to the free end of the fibre bundle in order to loosen and remove non-clamped constituents, wherein the mechanical device is associated with at least one of the first and second rollers; and wherein the fibre-sorting device further comprises at least one suction device associated with the clamping devices in a region of transfer of the fibre bundles from the supply device to the first roller, and/or in a region of transfer of the fibre bundles from the first roller to the second roller, wherein the at least one suction device comprises a plurality of suction channels.

7. An apparatus according to claim 6, in which each suction channel has an open end with a suction opening.

8. An apparatus according to claim 6, in which each suction channel has an end that is connected to a region of reduced pressure lower than that of the surrounding atmosphere.

9. An apparatus according to claim 6, in which the suction channels are arranged inside the first roller and/or inside the second roller.

10. An apparatus according to claim 6, in which the suction channels rotate with the first roller and/or the second roller.

11. An apparatus according to claim 6, in which at least one suction channel is associated with one of said clamping devices.

12. An apparatus according to claim 6, in which the first roller and/or the second roller includes an interior region comprising one or more reduced pressure regions.

13. An apparatus according to claim 12, in which the suction channels are connected to the one or more reduced pressure regions.

14. An apparatus according to claim 6, in which a suction flow between a reduced pressure region or regions and the individual suction channels is adjustable in such a manner that the suction flow is applied only at predetermined angular positions on the circumference of the roller.

15. An apparatus according to claim 14, in which movement of a component of the clamping devices causes the release of the suction flow.

16. An apparatus according to claim 1, in which a blown air current is provided in the region of the supply device.

17. An apparatus according to claim 1, in which a blown air current is provided in the region of the transfer between the first roller and the second roller.

18. An apparatus according to claim 16, further comprising a blown air current source arranged inside the supply device.

19. An apparatus according to claim 17, further comprising a blown air current source arranged in the region of transfer between the first roller and the second roller directly below and/or above each clamping device.

20. An apparatus according to claim 1, in which said first and second rotatably mounted rollers comprise at least one turning rotor and at least one combing rotor.

21. An apparatus according to claim 20, in which the turning rotor and the combing rotor have opposite directions of rotation.

22. An apparatus according to claim 1, in which to assist the suction of the supplied fibre material, at least one element for generating a blown air current is associated with the clamping devices in the region of the transfer of the fibre bundle from the supply device to the first roller and/or in the region of the transfer of the fibre material from the first roller to the second roller.

* * * * *